US006105684A

United States Patent [19]

Pointer et al.

[11] Patent Number: 6,105,684

[45] **Date of Patent: *Aug. 22, 2000**

[54] ROOF BOLTER OR A ROOF BOLT INSTALLATION APPARATUS

[75] Inventors: John Pointer, Seven Hills; Brad Nellson, Gwyneville; Peter Hanna, Heathcote, all of Australia

[73] Assignee: Cram Australia Pty Ltd, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 08/908,464

[22] Filed: Aug. 7, 1997

[30] Foreign Application Priority Data

Aug. 8, 1996 [AU] Australia ..... PO1525

[51] Int. Cl.[7] ..... E21B 7/02; B23Q 5/00

[52] U.S. Cl. ..... 173/27; 173/31; 173/37; 173/141; 173/147; 173/193; 173/196

[58] Field of Search ..... 173/141, 152, 173/36, 147, 4, 11, 193–96, 31, 37, 27

[56] References Cited

U.S. PATENT DOCUMENTS

| | | | |
|---|---|---|---|
| 1,519,981 | 12/1924 | Mott | 173/152 |
| 1,955,744 | 4/1934 | Huffman | 173/152 |
| 1,980,256 | 11/1934 | Curtis | 173/152 |
| 2,296,816 | 9/1942 | Curtis | 173/158 |
| 2,840,347 | 6/1958 | Feucht | 173/36 |
| 2,969,121 | 1/1961 | Wallace | 173/152 |
| 3,344,866 | 10/1967 | Kelley et al. | 173/193 |
| 3,552,504 | 1/1971 | Chappuis | 173/141 |
| 3,710,876 | 1/1973 | Christensen | 173/193 |
| 3,744,575 | 7/1973 | Strommes | 173/152 |
| 3,780,816 | 12/1973 | Arrington | 173/152 |
| 4,207,805 | 6/1980 | Johnsson | 173/31 |
| 4,601,000 | 7/1986 | Montabert | 173/11 |
| 5,431,234 | 7/1995 | Klemm | 173/152 |

*Primary Examiner*—Peter Vo
*Assistant Examiner*—James Calve
*Attorney, Agent, or Firm*—Marshall M. Curtis; James Earl Lowe, Jr.

[57] ABSTRACT

The present invention relates to improvements in the operation and construction of roof bolters or roof bolt installation apparatus. The improvements comprise a roof bolter constructed so that the critical moving parts of its timber jack, feed frame, feed carrier and rotational unit are comprised of a rod and sleeve construction. Such construction allowing the protection of surfaces. The construction also includes feature of a spaced apart rod and sleeve construction which allows motive power units to be housed within the confines of the timber jack and feed carrier. The spaced apart arrangement also provides stability to the roof bolter.

21 Claims, 14 Drawing Sheets

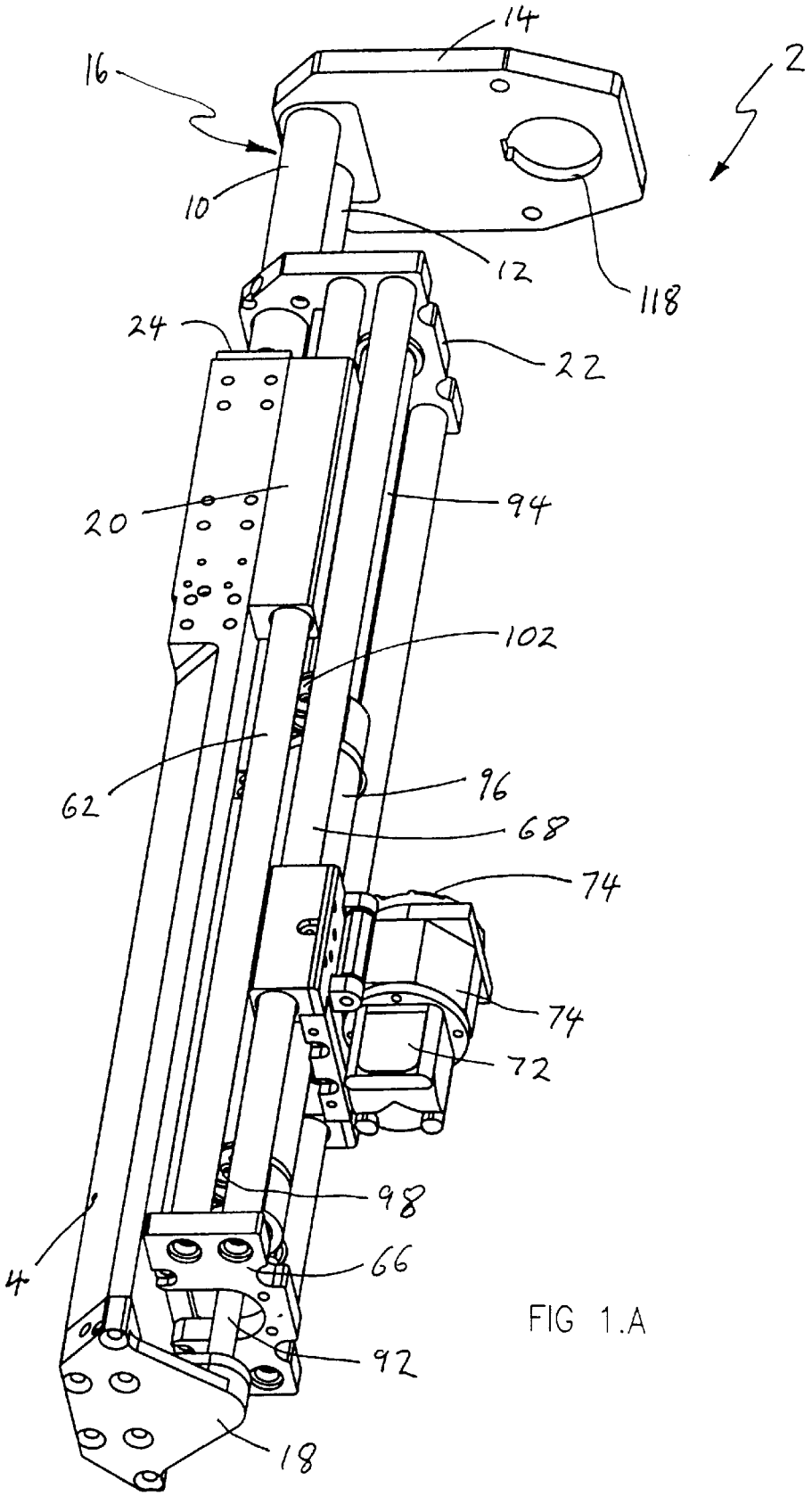
FIG 1.A

ROOF BOLTER OR A ROOF BOLT INSTALLATION APPARATUS

FIELD OF THE INVENTION

The present invention relates to roof bolt installation apparatus. Such apparatus could be of the type mounted on vehicles as an extension of a vehicle or on a vehicle frame itself.

BACKGROUND OF THE INVENTION

Throughout this specification the words "roof bolt" and derivations of these words are taken to include other strata stabilisation articles and other similar named bolting articles such as rock bolts, anchor bolts, anchor tendons, tendons and any other similar articles which can be used for any purpose including drilling and bolting of ribs, floors, walls and faces of mines and any other location requiring strata stabilisation.

The expression "roof bolt installation apparatus" when used in this specification and claims means an apparatus able to be predominantly used for roof bolting processes, but is also able to be used exclusively for drilling or coring purposes, without any actual installation of roof bolts. In which latter case the drilling unit, timber jack component and other components are simply used for drilling and or coring purposes alone.

Prior art roof bolt installation apparatus also known as roof bolters, generally have a timber jack which is constructed from a structural member sliding in another structural member. The sliding mechanism is generally achieved by the attachment of similarly shaped angled rails to each structural member. These rails are attached along the longitudinal length of the structural members so that one structural member can extend from a compacted or retracted height to approximately 1.75 times the compacted or retracted height. Such a timber jack braces the roof bolter so that a drilling unit can first drill a surface and then install a roof bolt.

Mounted on a base portion of the timber jack is a feed unit which slides relative to the base portion. On the feed unit is mounted the drilling unit which slides thereon. The sliding action is also produced and guided by means of similarly constructed externally mounted rails on the structural members and on corresponding portions of the feed unit so that the feed unit can slide relative to the base of the timber jack.

The sliding surfaces deteriorate relatively quickkly in service because during the life of a roof bolt installation apparatus it is deluged with water and coal, sandstone, rock and minerals which fall On the rails causing wear of the rails. Such wear occurs at an accelerated rate.

This wear damages the rails and can prematurely make the roof bolt installation apparatus inoperable because of potential misalignment of the respective sliding frames. This condition also means that the apparatus is prematurely withdrawn from service. Alignment is important when drilling is required into rock surfaces to ensure that a roof bolt will follow the same path as a drill rod which has gone before it to excavate the hole into which the roof bolt will be situated. Such alignment is also needed to ensure that the drill rod will make contact with a rock surface and not other portions of the roof bolter.

It is an object of the invention to provide a roof bolt installation apparatus which ameliorates, at least in part, at least one of the disadvantages of the prior art.

SUMMARY OF THE INVENTION

The invention provides a roof bolt installation apparatus which includes a jack means having a first member and a second member mounted thereon and a first travel means by which said second member can travel or slide relative to said first member to perform a jacking function; a carriage means engaging a portion of said first member and a second travel means by which said carriage means can travel or slide relative tc said portion of said first member; a rotational unit engaging said carriage means and a third travel means by which said rotational unit can travel or slide relative to said carriage means; wherein at least one said first, second or third travel means includes at least one rod which can slide in and out of at least one sleeve, said sleeve having an interior and one or two openings through which said at least one rod can move, wherein there is also included in said at least one sleeve at least one sliding sealing means to seal said interior of said at least one sleeve as said at least one rod travels through said at least one sealing means.

The invention also provides a roof bolt installation apparatus including a first member and a second member and a first travel mechanism so that said second member and said first member are slidably engaged whereby said second member can slide or travel relative to said first member to perform a jacking function; a carriage means connected by a moveable or slideable connection to said second member, said moveable or slideable connection being a second travel means which allows said carriage means to travel or slide relative to said second member; and a drilling unit connected by another moveable or slideable connection to said carriage means, said another moveable or slideable connection being a third travel means which allows said drilling unit to travel or slide relative to said carriage means, said second and or said third travel means cooperating to move said drilling unit towards or away from an end of said roof bolt installation apparatus, wherein at least one of said first, second or third travel means includes at least one rod which can slide relative to at least one sleeve, said at least one sleeve having an interior and one or two openings through which said at least one rod moves, wherein there is included in said at least one sleeve at least one sliding sealing means to seal the interior of said at least one sleeve as said at least one rod travels through said at least one sliding sealing means.

Preferably said first member includes said at least one sleeve and said second member includes said at least one rod.

Preferably said carriage means includes at least two rods, one to engage at least one sleeve on said first member and another to be engaged by at least one sleeve on said drilling unit.

Preferably there is at least one rod wiping means which cooperates with said at least one sealing means and is located on the outer side of said at least one sleeve relative to said interior and said at least one sealing means, to thereby clean said at least one rod before it re-enters said interior of said at least one sleeve.

Preferably one of said at least one rod and sleeve provides motive power to move said second member relative to said first member.

Preferably said first, second and third travel means each include at least one rod and one sleeve, and said first travel means is arranged so that said at least one rod provides motive power to move said second member relative to said first member, and at least one motor means independent of each of said at least one rod of said second and third travel means provides motive power simultaneously or sequentially to said carriage means and said drilling unit.

Preferably in the interior of said at least one sleeve of each of said first, second or third travel means there is located at least one bearing means.

Preferably said second member has an end which can engage a surface through which a roof bolt is to be installed.

Preferably said end of said second member provides a guiding means for a drill rod or a roof bolt placed in said drilling unit.

Preferably said end of said second member includes a rigid portion to which said at least one rod of said first travel means connects to, and a relatively flexible portion attached to said rigid portion which houses a guiding means for a drill rod or roof bolt.

Preferably said end of said second member includes a rigid portion to which said at least one rod of said first travel means connects to, and a relatively flexible portion attached to said rigid portion which houses a guiding means for a drill rod or roof bolt.

Preferably said drilling unit is linked to said carnage means by at least one flexible link.

Preferably said first, second and third travel means each include two rods and two sleeves to each receive each of said two rods.

Preferably said carriage means includes a guiding means which engages at least one of said rods of said first travel means.

Preferably all said rods are finished with a hard chrome finish.

Preferably all said rods are manufactured from high tensile steel.

Preferably said first member includes two elongated single opening sleeves, into and out of which slide two rod members of said second member.

Preferably said first member includes portion attached or formed integral with it, said portion including two sleeves, each sleeve having two openings to receive two rods of said carriage member.

Preferably said carriage means includes two spaced apart first rods to be received by said portion, and two spaced apart second rods which are also spaced from said first rods, said first and second rods being attached via two joining plates at the respective ends of said first and second rods.

Preferably said drilling unit includes a body which has two spaced apart sleeves which receive said two second rods of said carriage mean.

Preferably a first joining plate of said two joining plates is at a first end of said carriage means which is closest to an end of said apparatus that is meant to engage a surface to be drilled or roof bolted, said first joining plate engaging at least one of said two rods of said second member and are thereby guided when moving relative to said second member.

Preferably a second joining plate of said two join ing plates is at a second end of said carriage means which is furthest from an end of said apparatus that is meant to engage a surface to be drilled or roof bolted, said second joining plate including an aperture or bight for piston of a hydraulic cylinder carried by said carriage meant to protrude through said second joining plate and to engage either the ground or a stationary portion of said apparatus, to move said carriage means relative to said first and or said second members.

The invention further provides a roof bolt installation apparatus including a first member having at least one first sleeve means and a second member which is slidably engaged to said first member by said second member having at Ic ast one first rod engaging said at least one first sleeve means so that said second member is able to travel relative to said first member by said at least one first rod and sleeve means, and wherein there is provided a first motive power means, to cause travel of said second member relative to said first member; a carriage including at least one second rod which is slidably engaged by at least one second sleeve means in or on said first member, so that said carriage is able to travel relative to said first member by said at least one second rod and sleeve means, and wherein there is provided a second motive power means, to cause travel of said carriage relative to said first member; said carriage including at least one third rod to which is slidably engaged at least one third sleeve means formed with or connected to a drilling unit so that said drilling unit is able to travel relative to said carriage, and wherein there is provided a third motive power means, to cause travel of said drilling unit relative to said carriage.

Preferably said first motive power means is a linear actuator formed with one or more of said at least one first rod and sleeve.

Preferably said second motive power means is a linear actuator in one or more of said at least one second rod and sleeve.

Preferably third motive power means is part of one of said first or second motive power means or is independent thereto.

Preferably there is only one first rod and sleeve, one second rod and sleeve and one third rod and sleeve.

Preferably each one of said first, second and third rods and sleeves are located in an in-line relationship.

Preferably there is one or an odd number of first rods and sleeves, an even number of said second rods and sleeves and one or an odd number of third rods and sleeves, with the one or a middle one of said first and third rods and sleeves being contained in one plane with said second rods and sleeves being positioned symmetrically with respect to said one plane, and the rest, if any, of said first and third rods and sleeves being positioned symmetrically with respect to said one plane.

Preferably there is one or an odd number of first rods and sleeves, one or an odd number of said second rods and sleeves and an even number of third rods and sleeves, with the one or a middle one of said first and second rods and sleeves being contained in one plane and said third rods and sleeves being positioned symmetrically with respect to said one plane, and the rest, if any, of said first and second rods and sleeves being positioned symmetrically with respect to said one plane.

Preferably there is an even number of first rods a nd sleeves, one or an odd number of said second rods and sleeves and one or an odd number of third rods and sleeves, with the one or a middle one of said second and third rods and sleeves being contained in one plane with said first rods and sleeves being positioned symmetrically with respect to said one plane, and the rest, if any, of said second and third rods and sleeves being positioned symmetrically with respect to said one plane.

Preferably there is one or an odd number of first rods and sleeves, an even number of said second rods and sleeves and an even number of third rods and sleeves, with the one or a middle one of said first rods and sleeves being contained in one plane with said second and third rods and sleeves being positioned symmetrically with respect to said one plane.

Preferably there is an even number of first rods and sleeves, one or an odd number of said second rods and sleeves and an even number of third rods and sleeves, with the one or a middle one of said second rods and sleeves being contained in one plane with said first and third rods and sleeves being positioned symmetrically with respect to said one plane.

Preferably there is an even number of first rods and sleeves, an even number of said second rods and sleeves and one or an odd number of third rods and sleeves, with the one or a middle one of said third rods and sleeves being contained in one plane with said first and second rods and sleeves being positioned symmetrically with respect to said one plane.

Preferably there is an even number of first rods and sleeves, an even number of said second rods and sleeves and an even number of third rods and sleeves, with said first, second and third rods and sleeves being positioned symmetrically with respect to said one plane. Preferably, irrespective of the numbers of said first rods and sleeves, said second rods and sleeves and said third rods and sleeves, respective and corresponding ones of said rods and sleeves of said first rods and sleeves, and respective and corresponding ones of said rods and sleeves of said second rods and sleeves, and respective and corresponding ones of said rods and sleeves of said third rods and sleeves, are each located so that their central longitudinal axes are parallel to and at the same distance from a central longitudinal plane of said apparatus.

Preferably when said numbers of rods and sleeves is one or an odd number, the one or a middle one has its longitudinal axis located in said central plane is located said.

BRIEF DESCRIPTION OF THE DRAWINGS

Embodiments of the present invention will now be described, by way of example only, with reference to the accompanying drawings in which:

FIG. 1A is a perspective view of an apparatus embodying the invention

DETAILED DESCRIPTION OF THE EMBODIMENTS

Figures 1, 2:
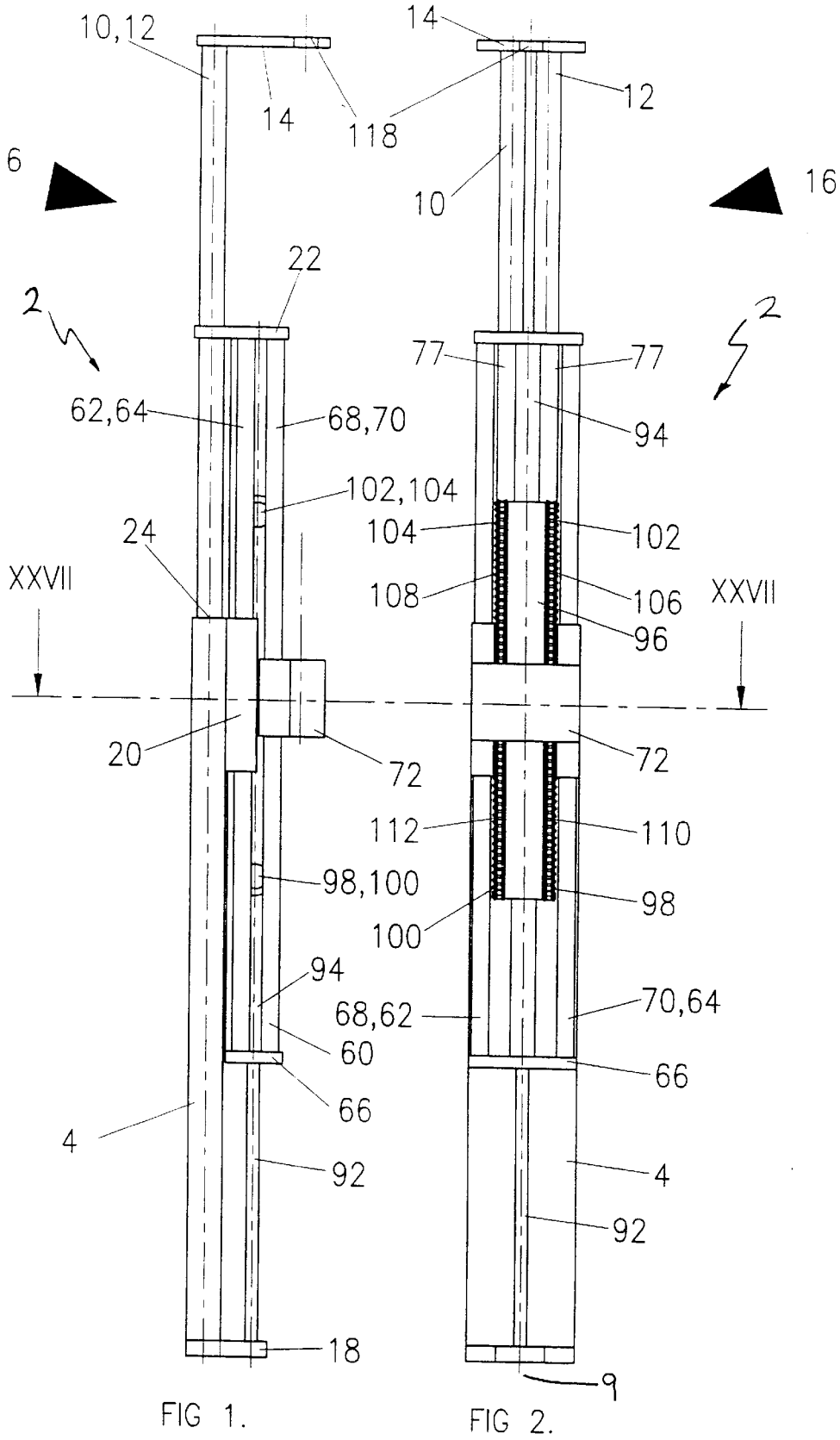
FIG. 1 is a side view of the apparatus of FIG. 1A.
FIG. 2 illustrates a front view of the apparatus of FIG. 1A.
Figure 3:
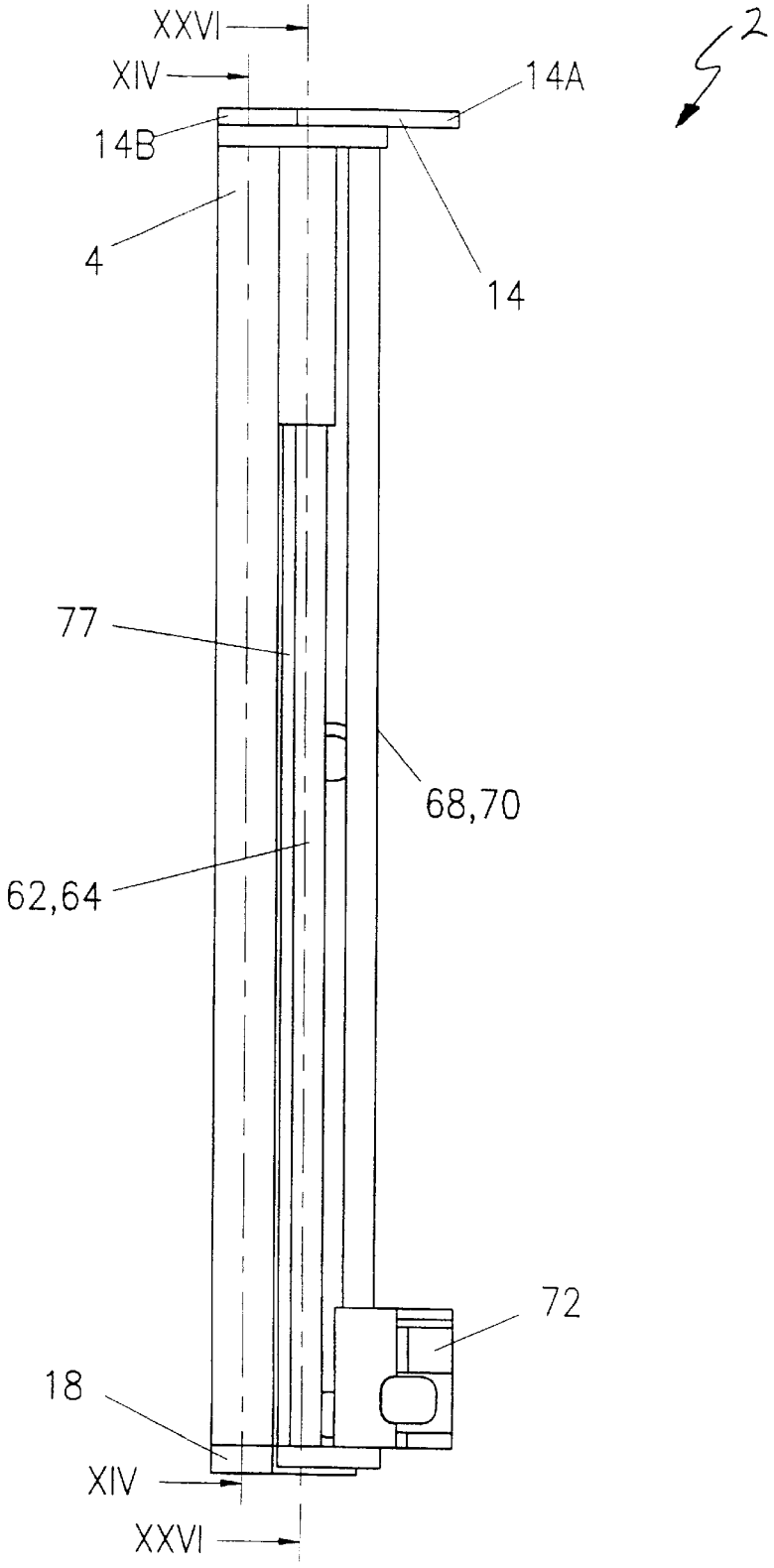
FIG. 3 illustrates the apparatus of FIG. 1A in the fully retracted position in side view.
Figure 4:
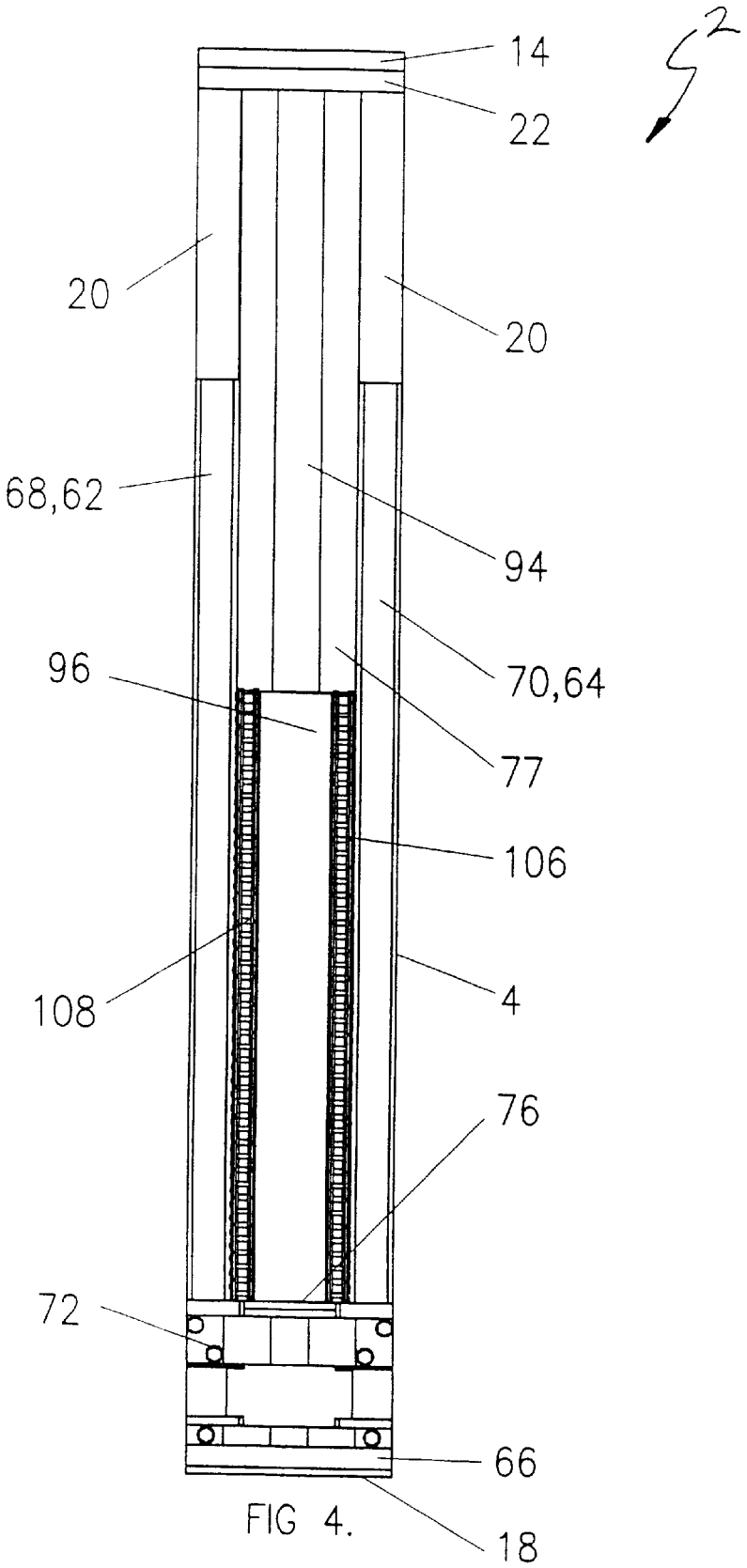
FIG. 4 illustrates the apparatus of FIG. 3 in front view.
Figure 5:
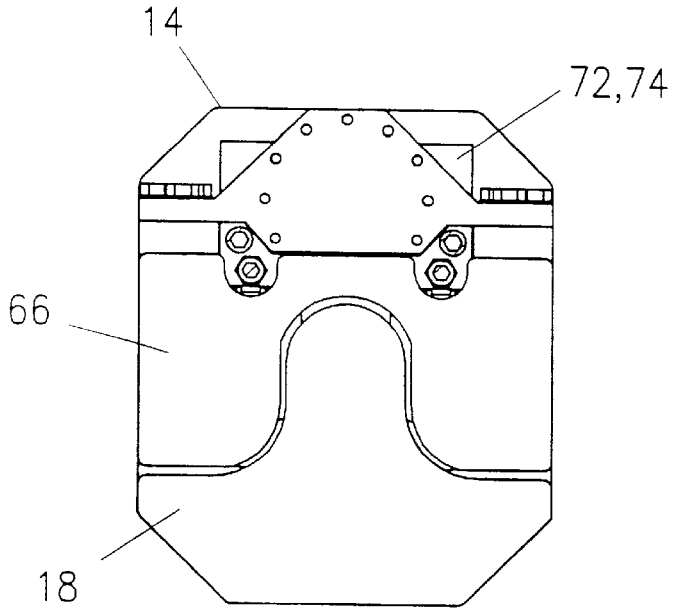
FIG. 5 illustrates an underneath view of the apparatus of FIGS. 3 and 4.
Figure 14:
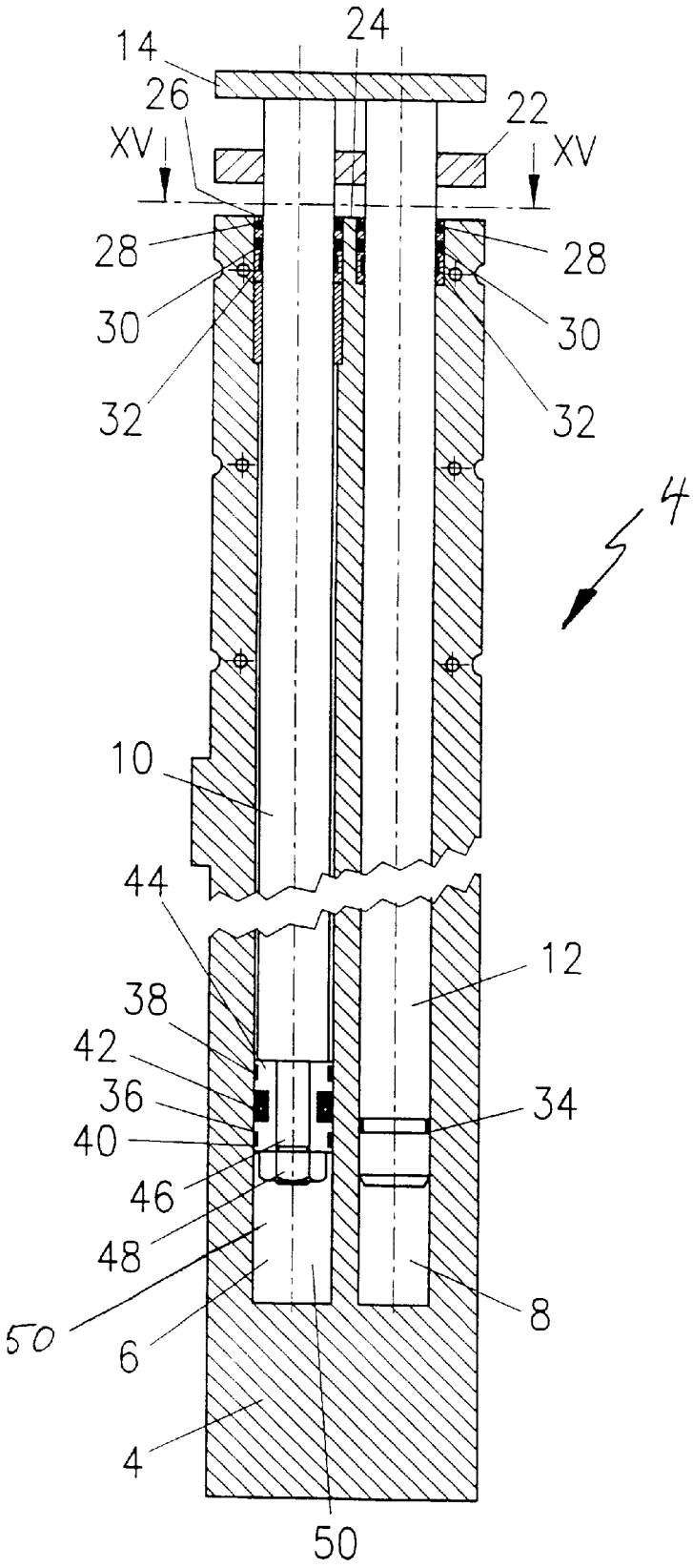
FIG. 14 illustrates a cross section through the line XIV—XIV of FIG. 3.
Figure 16:
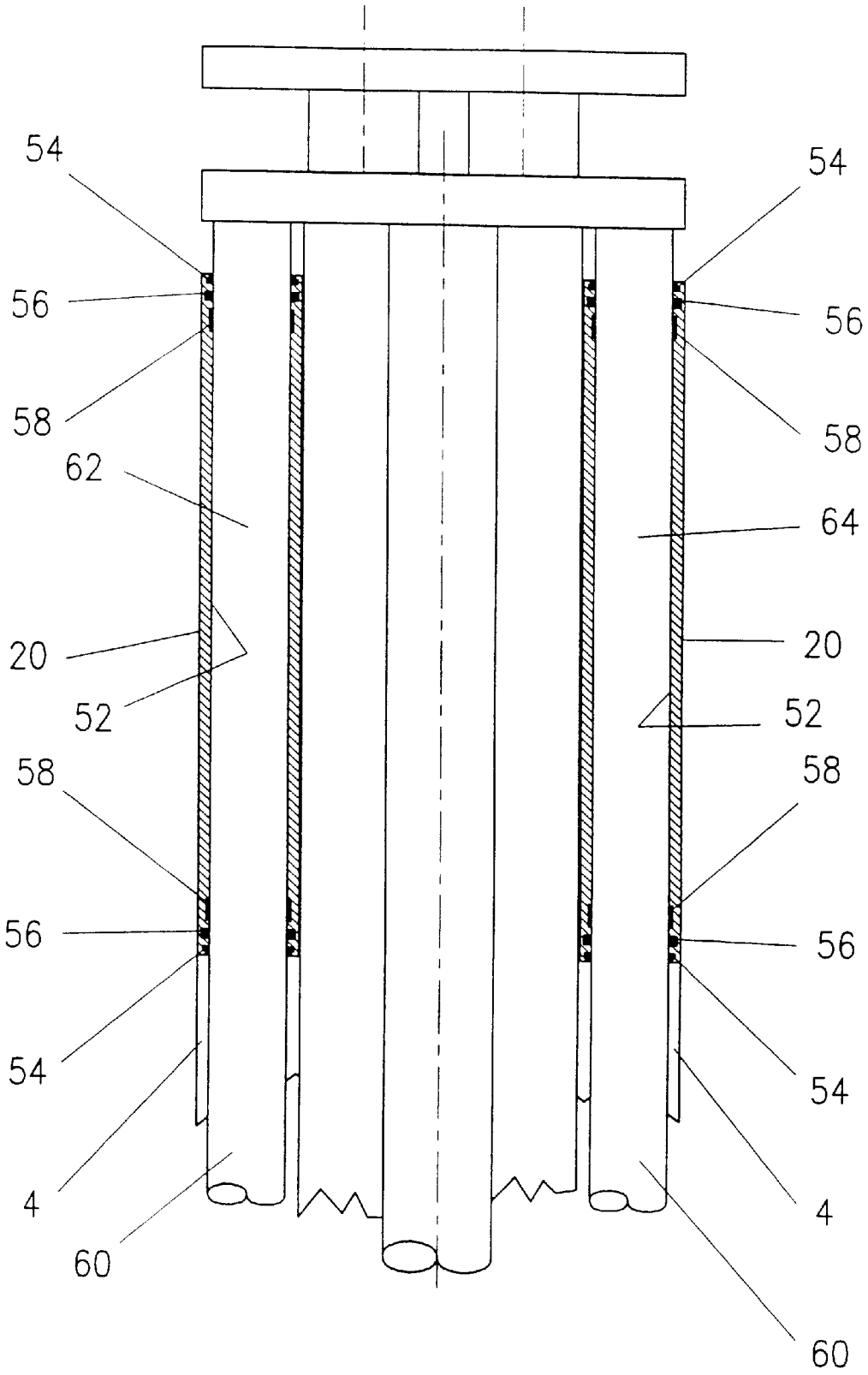
FIG. 16 illustrates a cross section through the line XXVI—XXVI of FIG. 15 and FIG. 3.

Illustrated in FIGS. 1A and 1 to 5 is a roof bolt installation apparatus or roof bolter 2 which has a first elongated member which acts as base and can also be called a feed carrier 4. The feed carrier 4 includes two elongated cylindrical bores 6 and 8 which are illustrated in FIG. 14. The bores 6 and 8 each provide a sleeve for the cylindrical rods 10 and 12 to travel or slide in. The feed carrier 4, bores 6 and 8, rods 10 and 12, a rectangular end plate 14 and a ported T-shaped block 18 (which is illustrated in FIG. 1, 3 and 4 and acts as a base member or foot for the roof bolter 2) together form an elongated timber jack 16, which can be used to brace the roof bolter 2 against opposite surfaces of a mine, tunnel or other structure. The T-shaped ported block 18 can be of any other appropriate shape.

The rods 10 and 12 are each connected (by any known means such as bolting or welding) to the end plate 14, to form a second member which is slidably mounted in the feed carrier 4. The slideable mounting of the rods 10 and 12 in bores 6 and 8 of the feed carrier 4, forms a first travel means or mechanism for the roof bolter 2.

The end plate 14 can be manufactured from a high tensile steel or other relatively rigid material. The end plate 14 acts as a guiding means for a drill rod or roof bolt passing through a bore 118, as is illustrated in FIGS. 1 and 2, and 12 and 13.

If the end plate 14 is wholly manufactured from a relatively rigid material, in some situations where the roof bolter 2 is moving in a mine or the operator is not aware of the shape of the surface which end plate 14 will contact, the end plate 14, because it is relatively rigid can transfer damaging bending moments to the rods 10 and 12. As a solution to this problem the end plate 14 can be manufactured, as illustrated in FIG. 3 and 4, as a two piece unit. The first portion 14A is a relatively rigid portion to which the rods 10 and 12 attach. The second portion 14B is made of a relatively flexible material such as polyurethane or composite material or other appropriate material. The second portion 14B can be attached to the first portion 14A by any known means such as bolting. Preferably the second portion is of limited flexibility and because of this flexibility compared to the first portion 14A, the second portion 14B will transfer reduced bending moments to first portion 14A and thus the rods 10 and 12. This will lead to rods 10 and 12 lasting longer by not transferring the damaging bending moment loads.

The material chosen for the second portion 14B must not hinder the guiding function of the bore 118. The bore 118, if a second portion 14B is used, may require modifications to allow for the flexibility of the second portion 14B.

The rods 10 and 12 are of a length so that they will fit inside the bores 6 and 8, so as to fully retract the end plate 14. In the full retracted posit ion, the end plate 14 sits adjacent a generally rectangular guide plate 22, which in turn sits adjacent the top 24 of the feed carrier 4.

The rods 10 and 12 are of circular cross section and are manufactured from high tensile steel, with a hard chrome finish. As illustrated in FIG. 14, the bores 6 and 8 pass through the feed carrier 4 and terminate in a single opening 26 at top 24. Near the opening 26 is located an annular wiper 28, an annular internal diameter sliding seal 30, and annular bearing 32 each in a gland portion, formed in the feed carrier 4. At the other end of the rod 12 is an annular bearing 34 which bears against the surface of the bore 8. The bore 8 and rod 12 do not act as a source of motive power to extend the timber jack 16 or to retract it.

The rods 10 and 12 are chosen with a circular cross section for ease of bearing, wiper and seal selection, however other shaped rods could be utilised providing they are adequately sealed with appropriate bearings and wipers, or are at least capable of being so.

However, the bore 6 and rod 10 do act as such a motor means, by forming a linear actuator. To achieve this motor function the opening 26 of the bore 6 as illustrated in FIG. 14, also includes the annular wiper 28, the annular internal diameter sliding seal 30, which is of sufficient sealing strength to bear the hydraulic pressures which can developed in the interior of the bore 6, and a bearing 32. At the other end of the rod 10 to the end plate 14, is an assembly 36 which has bearings 38 and 40 and a centrally located annular external diameter sliding seal 42. The bearings 38 and 40 and the seal 42 are carried on a carrier 44 which is positioned around a shank and thread 46 of the rod 10. The carrier 44 is secured to the rod 10 by means of the nut 48 being secured and tightened onto the shank and thread 46. A sealed chamber 50 is thus formed adjacent the nut 48. The sealed chamber 50 can be pressurised to create a linear actuator.

The assembly 36 allows the rod 10 to act as a source of motive power (a linear actuator) when the chamber 50 is pressurised by hydraulic fluid, because the seal 42 prevents hydraulic fluid by-passing the assembly 36. This makes the rod 10 act as a piston. When the chamber 50 is pressurised, the end plate 14 will move away from the top 24 of the feed carrier 4. In this way, and by subsequently maintaining pressure in the chamber 50, the end plate 14, rods 10 and 12 and the feed carrier 4 act as a timber jack, once end plate 14 makes contact with a surface into which a roof bolt is to be installed.

Near to the top 24 of the feed carrier 4 is formed or secured two generally rectangular elongated slide blocks 20. The slide blocks 20 have through them longitudinal bores 52 which perform the function of sleeves. The bores 52 have, at both ends, inside diameter annular wipers 54 which are close to the top and bottom ends of the slide blocks 20. Internally of the wipers 54 there are positioned annular sliding seals 56 and annular journal bearings 58 as it indicated in FIG. 17. The slide block 20 carries in the bores 52, cylindrical feed frame rods 62 and 64 of a feed frame 60. The slide block 20 and the feed frame rods 62 and 64 form a second travel means or mechanism of the roof bolter.

The feed frame rods 62 and 64 are each joined at one end to the guide plate 22 and at the other end are joined to end plate 66. The end plate 66 has a horse shoe shaped construction which might also be called U-shaped. The end plate 66 can be more clearly seen in FIG. 5. Its U-shape is such that the bight of the U opens inward in a direction towards the feed carrier 4. The feed frame rods 62 and 64 are joined to the end plate 66 at the end of the end plate 66 which is closest to the feed carrier 4. The end plate 66 is U-shaped in the preferred embodiment as it is the shape which is considered to provide for ease of installation of a hydraulic cylinder 90. Another shape of end plate 66 could also suffice, such as a rectangular plate which has a hole or aperture in it, so that piston rod 92 can pass through it, which also provides a shoulder against which outer stage cylinder rod 94 abuts.

The guide plate 22 has rods 10 and 12 running through two appropriately sized apertures in the guide plate 22. Once the timber jack 16 is at least partially extended, the rods 10 and 12 will extend beyond the end 24 whereby the rods 10 and 12 act as a guide for the guide plate 22 to travel along. The end plate 66, rods 62 and 64, guide plate 22 and end plate 66 form the first part of the feed frame 60. This slidably interconnected arrangement of the feed frame 60 and rods 12 and 10 results in the feed frame 60 being guided and supported at all times, by four rods, which results in a very stable and rigid travel mechanism for a drilling unit 72, which may give it a relatively high level of accuracy The second part of the feed frame 60 is made up of cylindrical rods 68 and 70 which are also connected at their respective ends to both guide plate 22 and end plate 66. At the end plate 66, the rods 68 and 70 are connected near to the ends of the legs of the U of the U-shaped end plate 66.

Figure 17:
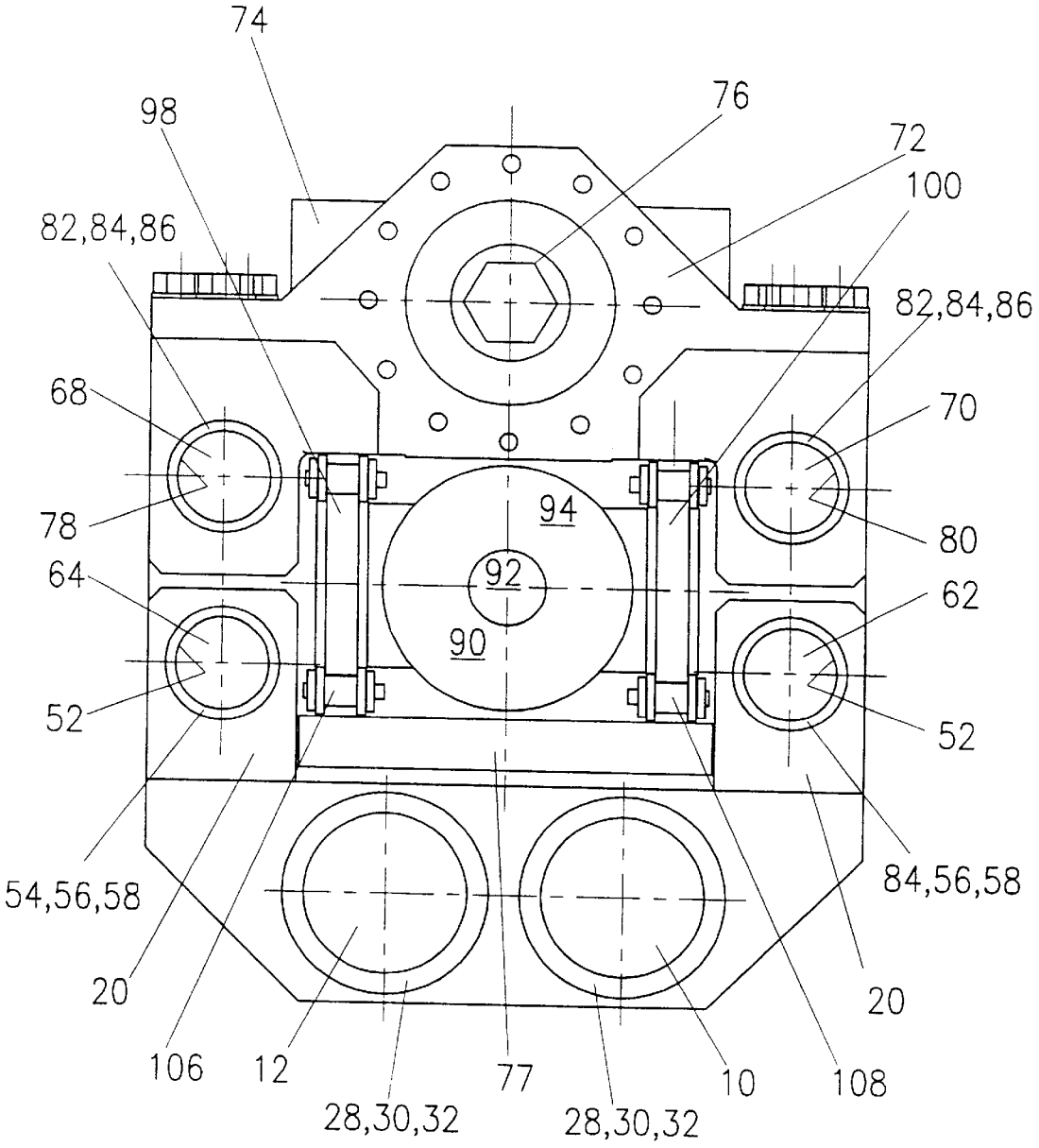
FIG. 17 illustrates a cross section through the line XXVII—XXVII of FIG. 1 and 2.
Figure 18:
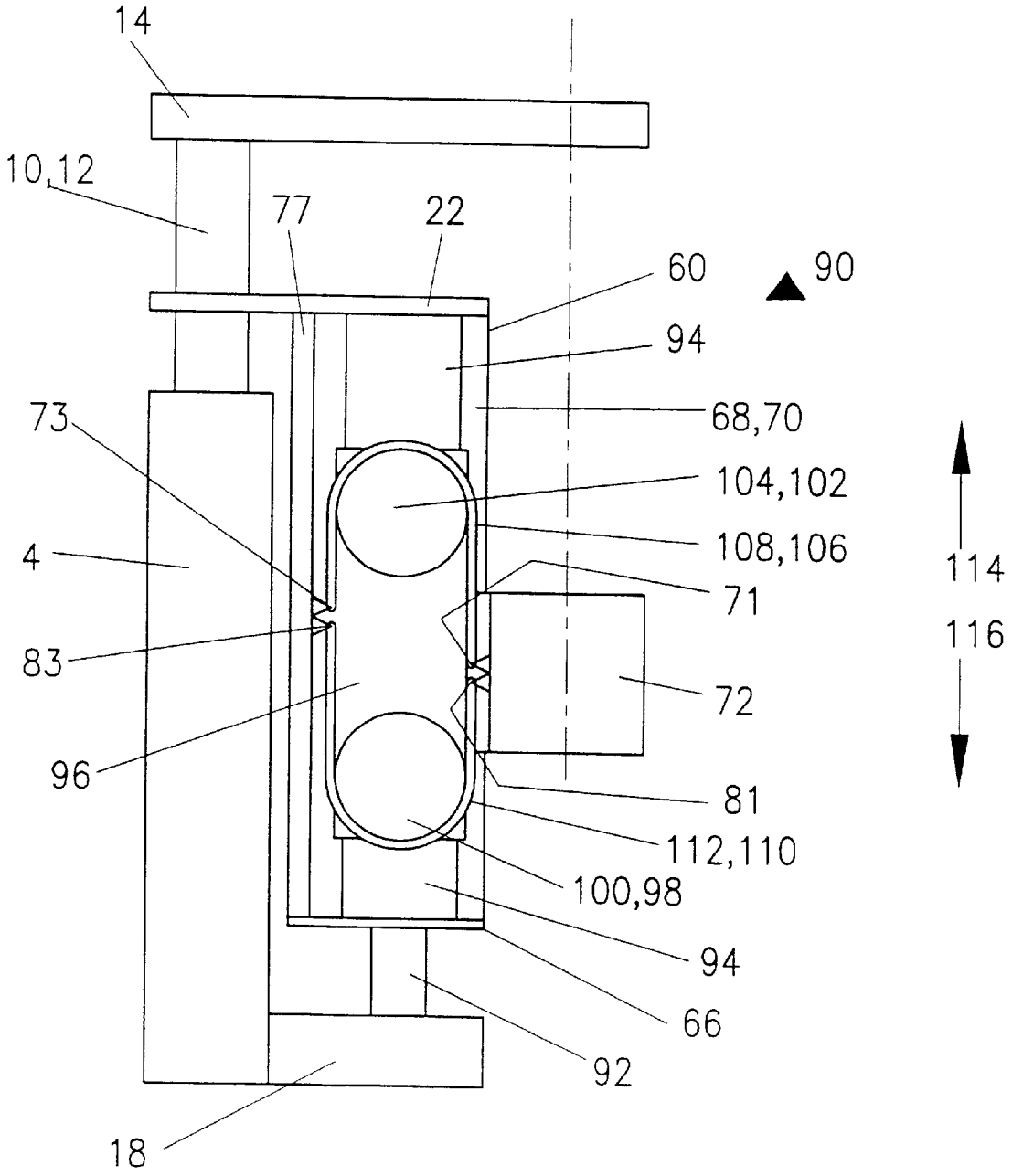
FIG. 18 illustrates a schematic view of he apparatus of FIG. 1A.

Slidably mounted on the rods 68 and 70 is a drilling unit 72 which is partly illustrated in plan view in FIG. 17. By the arrangement of these components, the feed frame 60 acts as a carriage means to carry the drilling unit 72. The drilling unit 72 includes a hydraulic motor 74 having a hexagonal drive 76, into which can be fitted the hexagonal end of a drill rod or a hexagonal nut on the end of a roof bolt. When placed in the hexagonal drive 76, a drill rod or roof bolt can be rotated to either drill a hole in a rock surface or alternatively rotate the roof bolt so as to mix resin placed in the hole and thus ultimately secure the bolt and tighten the nut to provide an anchor mechanism.

Alternatively, the drilling unit 72 could be a percussive type of drilling unit which drills only by cyclic or repetitive percussive forces. It could also be a rotational and percussive drilling unit which can be controlled to produce either percussive or rotational drilling or both. The drilling unit 72 does not need to be used just to install roof bolts. They could be used just to drill holes or take cores from walls, floors, faces, and ribs of mines or of any surface requiring strata stabilisation.

The third and final part of the feed frame 60 is made up of an anchor plate 77 and an outer stage cylinder rod 94 of a hydraulic cylinder 90. The purposes of the anchor plate 77 and the outer stage cylinder rod 94 will be described below.

Figure 20:
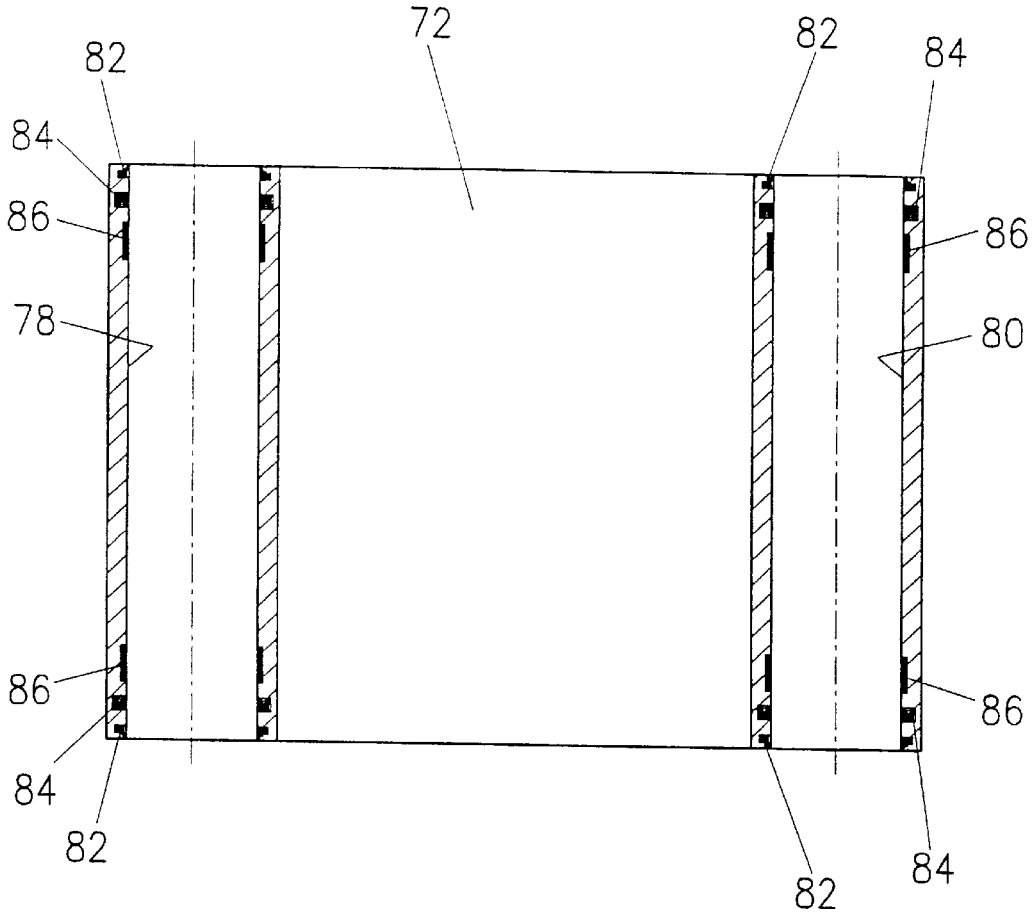
FIG. 20 is a cross section of a part of the sleeved component of a drilling unit 72 of FIG. 1A.

The drilling unit 72 has bores 78 and 80 through its housing in its left and right hand ends, which act as sleeves. As illustrated in FIG. 20, the bores 78 and 80 has positioned in each end, an inside diameter annular wiper 82, an inside diameter annular sliding seal 84 and an annular journal bearing 86.

The drilling unit 72, via the bores 78 and 80, is slidably mounted on the rods 68 and 70 of feed frame 60. The rods 68 and 70 and bores 78 and 80 of drilling unit 72 together form a third travel means or mechanism.

The rods 62, 64, 68 and 70 are manufactured in a similar manner to those of rods 10 and 12. These rods are also manufactured from high tensile steel which are given a hard chrome finish. The hard chrome finish on all of the rods 10, 12, 62, 64, 68 and 70 produces a smooth surface for the sliding seals 56, 30 and 84 to work effectively. The smooth surface aids the function of the corresponding bearings 32, 58 and 86.

Figure 19:
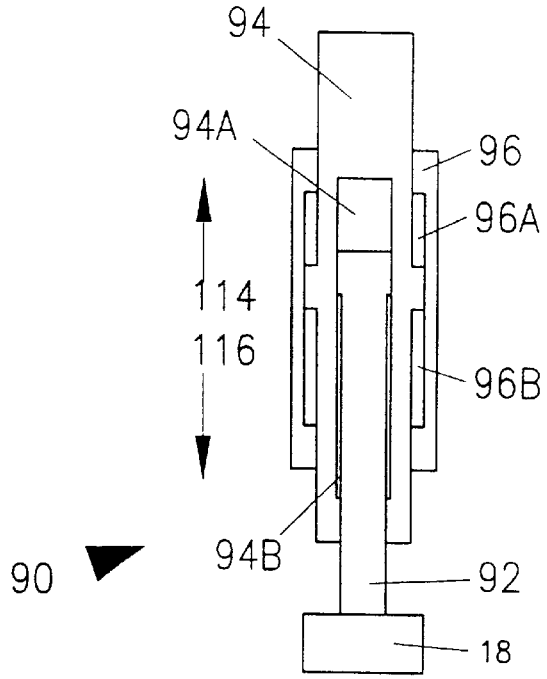
FIG. 19 illustrates a schematic view of a hydraulic cylinder for use with the apparatus of FIG. 1A.
Figure 15:
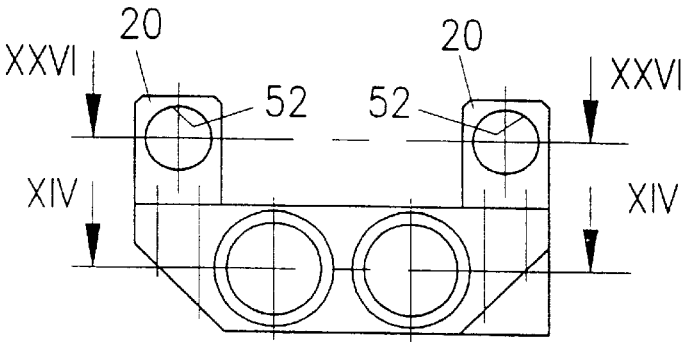
FIG. 15 illustrates a cross section through the apparatus of FIG. 14 in the direction of line XV—XV.

Illustrated in FIG. 19 and 20, there is arranged, internally of the feed frame 60 a two stage hydraulic telescopic cylinder 90. The hydraulic cylinder 90 has an inner stage cylinder rod 92 and an outer stage cylinder rod 94. The inner stage cylinder rod 92 is secured at its lowest end to the ported block 18. The outer stage cylinder rod 94 is secured at its respective ends to the end plate 66 and guide plate 22. The outer body 96, because of the support given to it by the outer stage cylinder rod 94 is thus also positioned in the feed frame 60.

At the bottom end and on either side of the outer body 96 are pulleys 98 and 100. At the top end and on either side of the outer body 96 are pulleys 102 and 104. The drilling unit 72 is connected to the ends 71 of chains 106 and 108. The chains 106 and 108 pass over pulleys 102 and 104 and are secured at ends 73 to the anchor member 77, which is installed in the feed frame 60. This assembly forces the drilling unit 72 to move in the direction of arrow 114, when the outer body 96 moves in the direction of arrow 114 relative to the outer stage cylinder rod 94. Whereas the chains 110 and 112 are secured at one end 81 to the drilling unit 72, and pass respectively around the pulleys 98 and 100 and have their ends secured at 83 to anchor member 77 so that the drilling unit 72 will move in the direction of arrow 116 when the outer body 96 also moves in the direction of arrow 116, relative to the outer stage cylinder rod 94.

The arrangements of the chains 106, 108, 110 and 112 and their interaction with the pulleys 102, 104, 98 and 100 is such that the rate of movement of the outer body 96 of the hydraulic cylinder 90 relative to the drilling unit 72 is in the ratio of 2 to 1.

Figure 6:
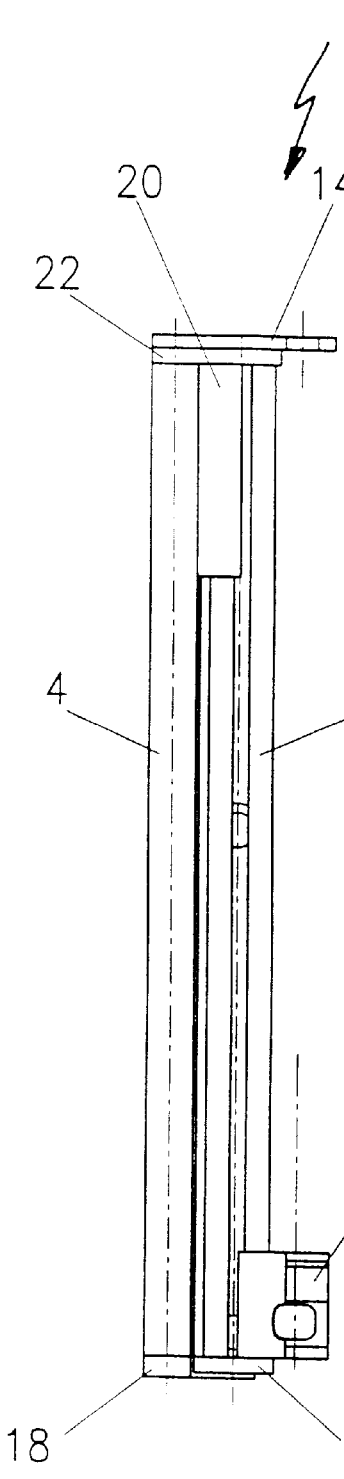
FIG. 6 to FIG. 13 illustrates side views and front views of the apparatus of FIGS. 1 to 5 showing the steps of deployment.
Figure 7:
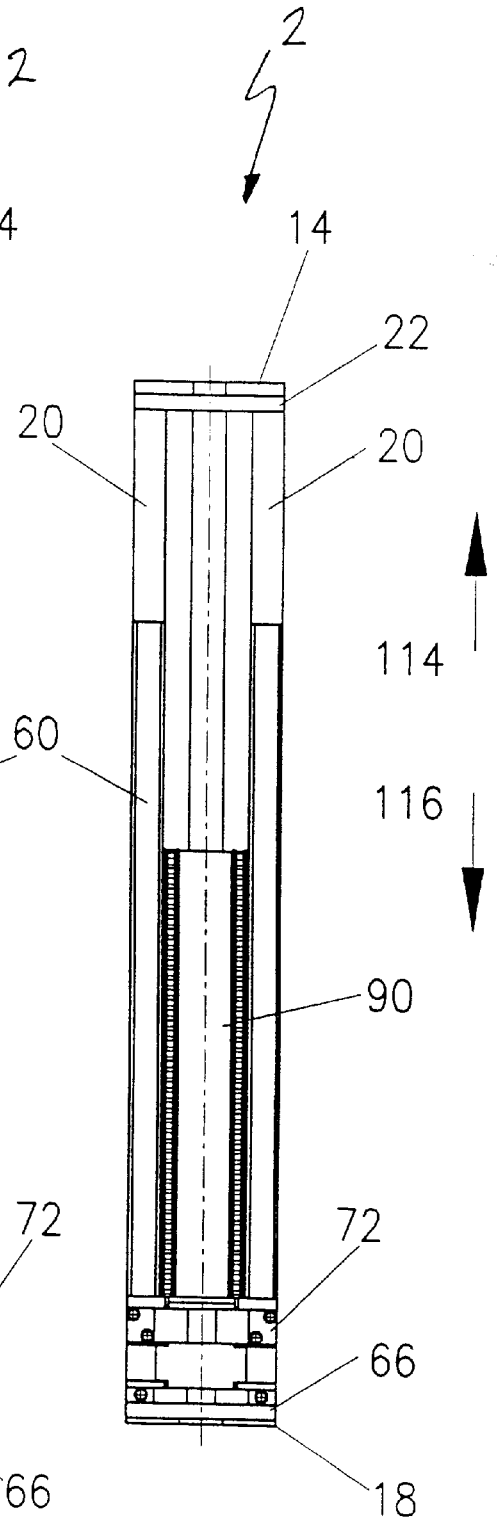

FIGS. 6 and 7 illustrate a roof bolter 2 in its fully retracted position. In this position the timber jack 16 is fully retracted and so is the drilling unit 72 and the feed frame 60 relative to ported block 18. In this position the end plate 14 and the guide plate 22 lie adjacent to each other, which in turn is adjacent to the top 24 (of FIG. 14) of the feed carrier 4. In this condition neither the chambers 94A or 96A (see FIG. 19) of the hydraulic cylinder 90 nor the chamber 50 of the bore 6, has any oil or air pressure applied to it.

Figures 8, 9:
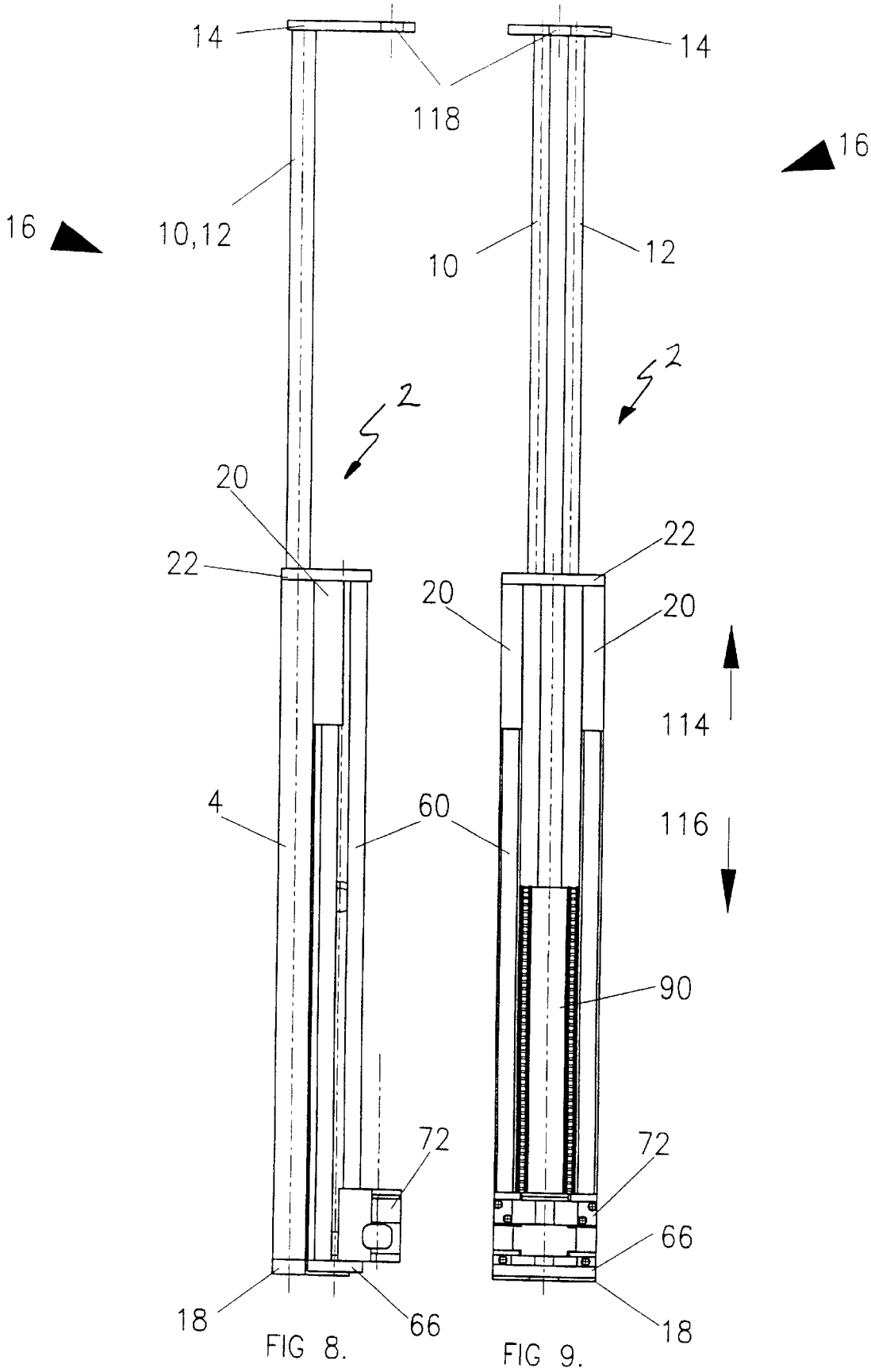

Upon pressurising the chamber 50 (of FIG. 14), the rod 10 is forced out of the bore 6 past the bearing 32, seal 30 and wiper 28, so as to adopt the position as in FIGS. 8 and 9 where the end plate 14 is at its maximum distance from the top 24 of feed carrier 4, unless it is otherwise blocked or stopped.

The extension of the timber jack 16 need not be to its full length or height (due to height or width constraints in a mine or tunnel), for the feed frame 60 and the drilling unit 72 to be operated for the installation of a roof bolt. An operator will apply as much pressure as is necessary and then maintain that pressure so that the timber jack 16 can keep the ceiling and floor of the mine, or two walls, separated by the desired pressure.

Figures 10, 11:
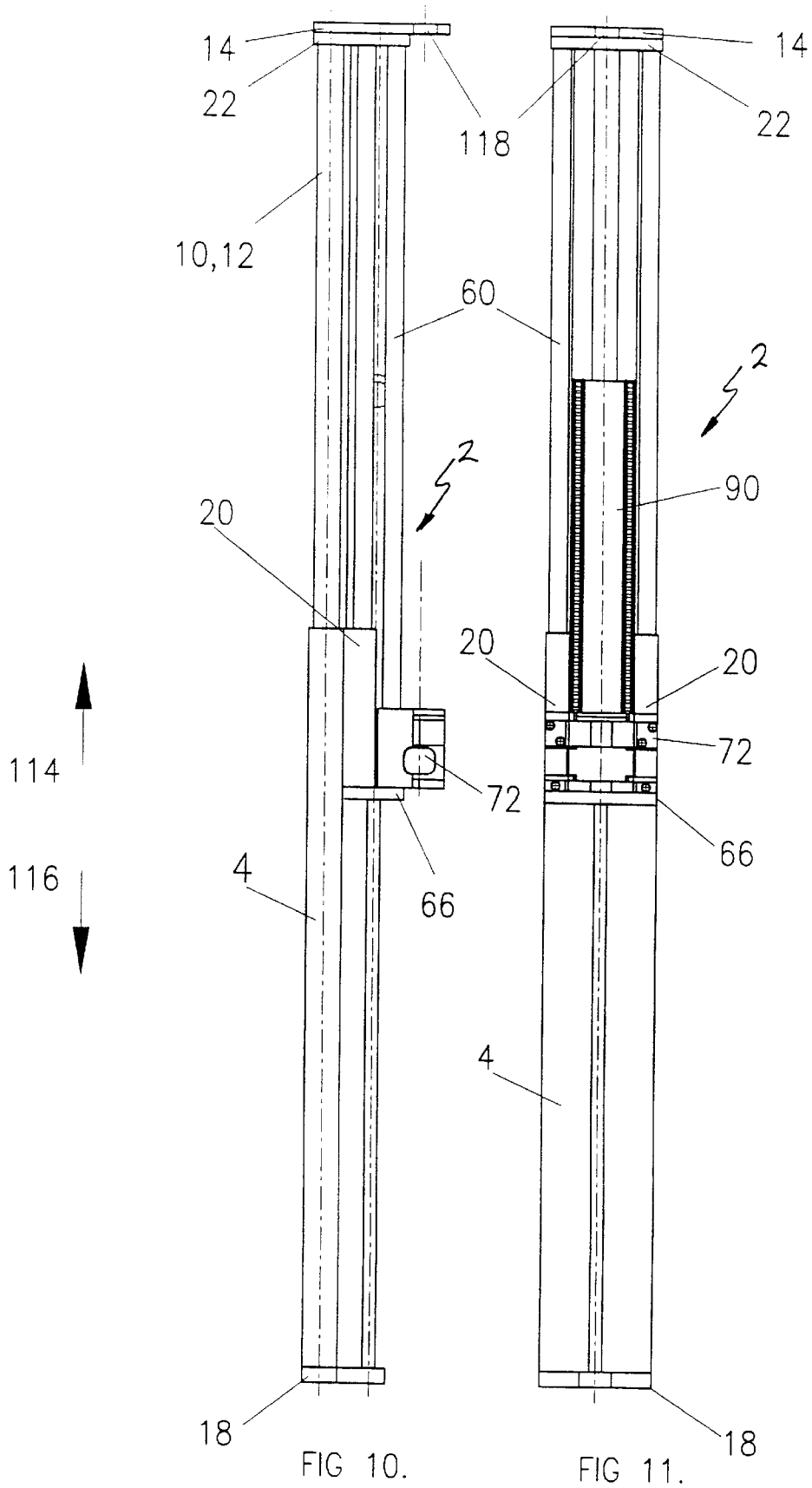

At the next step in the extension/retraction of the roof bolter 2, the hydraulic cylinder 90 has oil pumped into its chamber 94A under pressure, so that the outer body 96 and the outer stage cylinder rod 94 travel together in the direction of arrow 114 along the inner stage cylinder rod 92. This forces the feed frame 60 to slide in the slide block 20 to the position adopted in FIGS. 10 and 11.

Continued application of oil pressure to chamber 94A and then to chamber 96A of the hydraulic cylinder 90 will force the outer body 96 of the hydraulic cylinder 90 to move relative to the outer stage cylinder rod 94 in the direction of arrow 114, forcing the drilling unit 72 to also move in the direction of arrow 114. This is because as the outer body 96 moves in the direction of arrow 114, the end of the chains 108 and 106 are connected to the anchor member 17, thus forcing the chains 106 and 108 to rotate around pulleys 104 and 102 and thus lift the drilling unit 72 into the position as illustrated in FIGS. 12 and 13.

While the drilling unit 72 is stationary as in any of FIGS. 8 through to 11, an operator can position in the hexagonal drive 76, a drill rod (not illustrated) which is to be rotated by the drilling unit 72. The drilling unit 72 is then moved towards the end plate 14 until the drill rod rests against a surface of a mine or tunnel which is to be drilled. Once the hole in the same surface is drilled, a drill rod can be replaced by a roof bolt. The end plate 14 has the guide hole 118 through it so that a drill rod or subsequent roof bolt can pass through the end plate 14. The guide hole 118 also helps to guide the drill rod and roof bolt in a straight line along axis 120.

When each of the rods 10, 12 are fully extended or partially extended and when the drilling unit 72 is drilling or rotating a roof bolt, the roof bolter 2 is constantly deluged with flushing water. Highly abrasive sandstone and other debris and particles can settle onto the surfaces of all the rods 10, 12, 62, 64 and 68 and 70. However, due to the presence of the wipers 26, 54, 82 and the seals 30, 56, and 84, as the timber jack 16 is retracted back into the feed carrier 4, and the feed frame 60 slides back to the rest position of FIGS. 6 and 7, and the drilling unit 72 also slides along the feed frame from its extended position of FIGS. 12 and 13 to its retracted position of FIGS. 6–11, the rods are wiped clean preventing any dirt entering the mechanisms and bores of the first, second and third travel means or mechanisms.

Figures 12, 13:
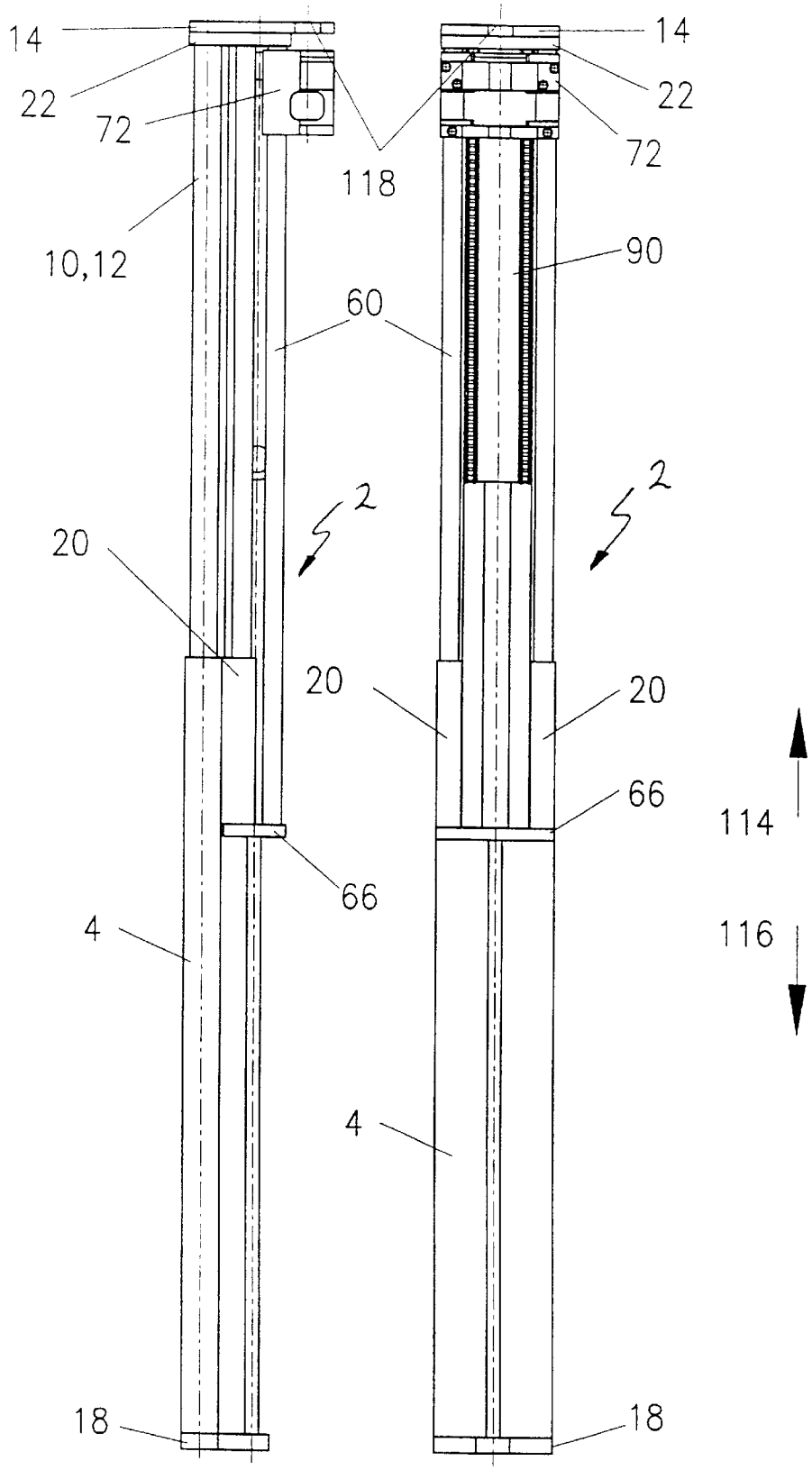

When oil or air pressure is applied to the side chambers 94A and 96B of the hydraulic cylinder 90 and the retract side of the linear actuator formed in the bore 6 by the rod 10 and assembly 46, the roof bolter 2 will retract progressively through the positions as shown from FIGS. 13 to 6. In this downward or retraction motion, in the direction of arrow 116, as the outer body 96 of hydraulic cylinder 90 moves in the direction of arrow 116 relative to the outer stage cylinder rod 94, the pulleys 98 and 100 act against the chains 110 and 118 which are anchored to the anchor member 77 to drag the ends 81 of chains 112 and 110 in the direction towards the pulleys 98 and 100, thus forcing the drilling unit 72 to move also in the direction of arrow 116.

If desired, inner stage 92 of hydraulic cylinder 90 can be replaced by one of the rods 62 or 64, or both of them, having an internal single opening sleeve in which is slidably engaged a rod, together with the appropriate bearings, seals, wipers and hydraulic connections. The rod can be connected to the ported block 18 in much the same way that inner stage cylinder rod 92 is engaged. When oil pressure is applied to the thus formed linear actuator in the rods 62 and 64, the feed frame 60 will move in the directions of arrows 114 and 116.

When the timber jack 16 is in its fully extended position, as in FIGS. 8 to 13, the rods 10 and 12 and the lengths of the bores 6 and 8 are such that in the fully extended position there still remains in the bores 6 and 8 some 250 mm to 30 mm of rods 10 and 12. This 250 mm to 300 mm of overlap at the fully extended position helps provide strength to resist buckling of the timber jack 16. For this same reason the slide block 20 is also of approximately 300 mm to 400 mm in length to provide the similar resistance to forces and to maintain buckling strength.

If it is desired to make the roof bolter 2 a complete auto retract system, limit switches can be provided to limit the amount of travel of the rods of the first, second and third travel means, so that the timber jack 16, the feed frame 4 and the drilling unit 72 return after travelling beyond predetermined points. Also if desired, an auto retract switch can be provided on the drilling unit 72 so that as it contacts the end plate 14, the control system retracts the drilling unit 72 to its start position.

If it is desired and if the above components are increased in size and strength, any or all of the twin rod systems described above could be replaced by single rod systems which may be located in an in-line relationship. However one of the difficulties of single rod systems is the opportunity of off centre loads to be applied which may result in high bending moments being applied to the roof bolter 2. The twin rod and double twin rod feed frame with a centrally positioned hydraulic cylinder as described for roof bolter 2 above, helps to reduce the difficulties caused by off centre loading, because of the symmetrical positioning of the rods relative to a single plane into the page of FIG. 2 which single plane includes the central longitudinal axis 9 of the roof bolter 2.

An alternative construction would be to replace the twin rod system of the timber jack comprised of the set of rods 10 and 12, the twin rod system comprised of the set of rods 62 and 64, and the twin rod system comprised of the set of rods 68 and 70 which could respectively be described as a (2-2-2) rod system, by a system respectively comprised by one of: (1-1-2), (1-2-1), (2-1-1), (1-2-2), (2-1-2), or (2-2-1) sets of rods. A more general number of rods could be described by a system comprised respectively of: (an odd number-an odd number-an even number) sets of rods, (an odd number-an even number-an odd number) sets of rods, (an even number-an odd number-an odd number) sets of rods, (an odd number-an even number-an even number) sets of rods, (an even number-an odd number-an even number) sets of rods, or (an even number-an even number-an odd number) sets of rods. However, with respect to these systems each set of rods and sleeves, will need to be arranged so that the rods and sleeves of a single set are symmetrically located around a single central plane. Also, where there is one or an odd number of rods and sleeves, the one or a middle one of a set of rods and sleeves will need to be located in the single central plane. Also, if there is an odd number of rods and sleeves, the rest of the rods and sleeves other than the middle one will need to be symmetrically located around the single central plane. Such a plane could be the single plane into the page of FIG. 2 which includes the central longitudinal axis 9 of the roof bolter 2.

By providing the roof bolter 2 with sliding seals and wipers, the accuracy and directional stability of the roof bolter 2 is maintained for a much longer time than the prior art systems. This is because there is very little wear which occurs due to debris and contaminants invading the sliding surfaces which would tend to accelerate the wear by the grinding of such debris and particles.

Wear can be further reduced by means of the sealed nature of the first, second and third travel means or mechanisms, which allow return oil to the ported to the sliding surfaces of the first, second and third travel means or mechanisms so that they can be lubricated by this oil.

The internalising of the sliding mechanisms of the first, second and third travel means or mechanism makes a roof bolter 2 of the above embodiment generally more compact than any previously made roof bolter.

If desired the roof bolter of the above embodiment can be mounted on an arm for attachment to a vehicle, such mounting can be done by attachment of the arm to the feed carrier 4. Alternatively, the system can be included onto a chassis so that the ported block 18 or base does not make contact with the ground but rather makes contact with a chassis of a vehicle, which chassis in turn makes contact with the ground by means of its tracks or wheels.

The bores or sleeves and the rod and frame constructions utilised in the roof bolter 2 are such that a relatively rigid drill platform is produced. This feature, together with the reduction or delay of clearance caused by wear, and the guide plate 22 providing extra stiffness for the feed frame 60, makes the roof bolter 2 eminently suited for automation of the roof bolting process.

The foregoing describes some embodiments of the present invention and modifications by those skilled in the art can be made thereto without departing from the scope of the present invention.

What is claimed is:

1. A roof bolt installation apparatus including a drill stabilizing means including a base having a pair of parallel cylindrical bores therein and two stabilizing rods, each of which is extendable from said base and which is slidably located in one of said bores, and each of said rods having a distal end, and connection means connecting said distal ends to hold said rods together to ensure said rods slide in said cylindrical bores in unison, a drilling unit carriage including a first rod and a second rod spaced apart from and parallel to said first rod, a drilling unit which is adapted to rotatably carry a drill, said drilling unit being slidably mounted on said drilling unit carriage first rod, and means for moving said drilling unit along said drill stabilizing means, said moving means including a sleeve attached to said drill stabilizing means base and surrounding and slidably receiving a portion of said drilling unit carriage second rod, means between said drill stabilizing means base and said drilling unit carriage for moving said drilling unit carriage along said drill stabilizing means, and means for moving said drilling unit relative to said drilling unit carriage.

2. A roof bolt installation apparatus according to claim 1 wherein said drill stabilizing means extendable rod is circular in cross section.

3. A roof bolt installation apparatus according to claim 1 wherein said drill carriage first rod is circular in cross section and wherein said drill carriage second rod is circular in cross section.

4. A roof bolt installation apparatus according to claim 1 wherein said drill stabilizing means extendable rod has an end which can engage a surface through which a drill rod can extend.

5. A roof bolt installation apparatus according to claim 4 wherein said extendable rod end provides a guiding means for a drill rod placed in said drilling unit.

6. A roof bolt installation apparatus according to claim 1 wherein said sleeve has an interior and two openings through which said drilling unit carriage second rod moves, wherein there is included in said sleeve at least one sliding sealing means to seal the interior of said sleeve as said drilling unit carriage second rod travels through said sleeve.

7. A roof bolt installation apparatus according to claim 6 wherein there is at least one rod wiping means which cooperates with said at least one sealing means and is located on an outer side of said sleeve relative to said interior and said at least one sealing means, to thereby clean said at least one rod before it re-enters said interior of said sleeve.

8. A roof bolt installation apparatus according to claim 1 wherein said drilling unit carriage includes a second first rod and a second second rod, said drilling unit also being slidably mounted on said second first rod and a second sleeve attached to said drill stabilizing means base and also surrounding and slidably receiving a portion of said drilling unit second second rod.

9. A roof bolt installation apparatus according to claim 1 wherein said means for moving said drilling unit carriage along said drill stabilizing means is an extendable cylinder between said drill stabilizing means base and said drilling unit carriage.

10. A roof bolt installation apparatus according to claim 9 wherein said extendable cylinder between said base and said carriage is a two stage hydraulic cylinder.

11. A roof bolt installation apparatus including a drill stabilizing means including a base and a stabilizing rod which is extendable from said base, a guide plate, an end plate, a drilling unit carriage including a first rod pair and a second rod pair attached to and extending between said guide plate and said end plate, said first and second rod pairs being all spaced apart from and parallel to each other, a drilling unit which is adapted to rotatably carry a drill, said drilling unit being slidably mounted on said drilling unit carriage first rod, and means for moving said drilling unit along said drill stabilizing means, said moving means including a first sleeve attached to said drill stabilizing means base and surrounding and slidably receiving a portion of one of said drilling unit carriage second rod and a second sleeve attached to said drill stabilizing means base and surrounding and slidably receiving a portion of the other of said drilling unit carriage second rod, means between said drill stabilizing means base and said drilling unit carriage for moving said drilling unit carriage along said drill stabilizing means, and means for moving said drilling unit relative to said drilling unit carriage.

12. A roof bolt installation apparatus according to claim 11 wherein said drill stabilizing means extendable rod is circular in cross section.

13. A roof bolt installation apparatus according to claim 11 wherein said drill carriage first rod is circular in cross section and wherein said drill carriage second rod is circular in cross section.

14. A roof bolt installation apparatus according to claim 11 wherein said drill stabilizing means extendable rod has an end which can engage a surface through which a drill rod can extend.

15. A roof bolt installation apparatus according to claim 14 wherein said extendable rod end provides a guiding means for a drill rod placed in said drilling unit.

16. A roof bolt installation apparatus according to claim 11 wherein said sleeve has an interior and two openings through which said drilling unit carriage second rod moves, wherein there is included in said sleeve at least one sliding sealing means to seal the interior of said sleeve as said drilling unit carriage second rod travels through said sleeve.

17. A roof bolt installation apparatus according to claim 16 wherein there is at least one rod wiping means which cooperates with said at least one sealing means and is located on an outer side of said sleeve relative to said interior and said at least one sealing means, to thereby clean said at least one rod before it re-enters said interior of said sleeve.

18. A roof bolt installation apparatus according to claim 11 wherein said drill stabilizing means includes a second extendable rod.

19. A roof bolt installation apparatus according to claim 11 wherein said means for moving said drilling unit carriage along said drill stabilizing means is an extendable cylinder between said drill stabilizing means base and said drilling unit carriage.

20. A roof bolt installation apparatus according to claim 19 wherein said extendable cylinder between said base and said carriage is a two stage hydraulic cylinder.

21. A roof bolt installation apparatus according to claim 11 wherein said guide plate has an opening which slidably receives said stabilizing means rod.

* * * * *